United States Patent [19]

Gutermuth et al.

[11] 4,099,941

[45] Jul. 11, 1978

[54] CONDENSER CEILING FOR KITCHENS

[76] Inventors: Paul Gutermuth, Augustastrasse 48, D-6456 Langenselbold; Heinrich Oetjen, August-Bebel-Strasse, 11, D-6451 Bruchkobel; Paul Gutermuth, Jr., Augustastrasse 48, D-6456 Langenselbold, all of Fed. Rep. of Germany

[21] Appl. No.: 834,022

[22] Filed: Sep. 16, 1977

[30] Foreign Application Priority Data

Sep. 16, 1976 [DE] Fed. Rep. of Germany ..... 2641708

[51] Int. Cl.[2] ..... B01D 51/00

[52] U.S. Cl. ..... 55/269; 55/439; 55/440; 55/DIG. 36

[58] Field of Search ..... 55/183–186, 55/267, 269, 439–440; 126/299 A

[56] References Cited

U.S. PATENT DOCUMENTS

| | | | |
|---|---|---|---|
| 3,459,115 | 8/1969 | Gutermuth | 55/DIG. 36 |
| 3,751,885 | 8/1973 | McNeely | 55/267 |
| 3,984,505 | 10/1976 | Gutermuth et al. | 55/DIG. 36 |

*Primary Examiner*—Charles N. Hart
*Assistant Examiner*—Richard W. Burks
*Attorney, Agent, or Firm*—Sughrue, Rothwell, Mion, Zinn and Macpeak

[57] ABSTRACT

A subceiling 10 for kitchens and the like includes upwardly arched condenser panels 12 whose free edges are disposed above hollow, U-shaped collecting channels 14. The interiors of the channels may be supplied with cold water to promote condensation or with hot water to melt and drain off fatty deposits.

6 Claims, 7 Drawing Figures

Fig. 2
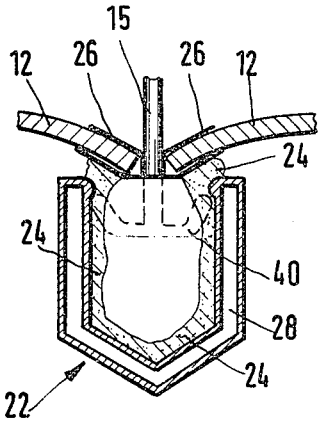
Fig. 3a
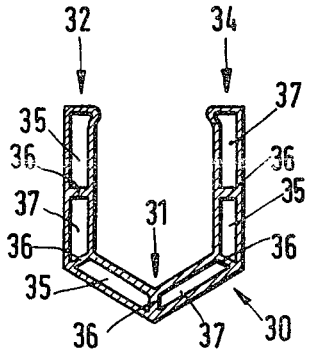
Fig. 3b
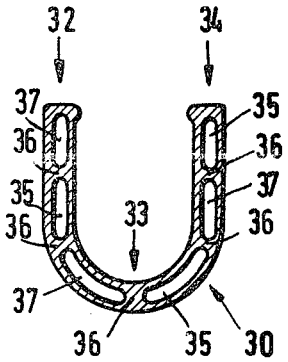
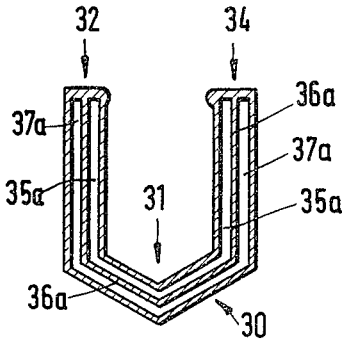
Fig. 3c
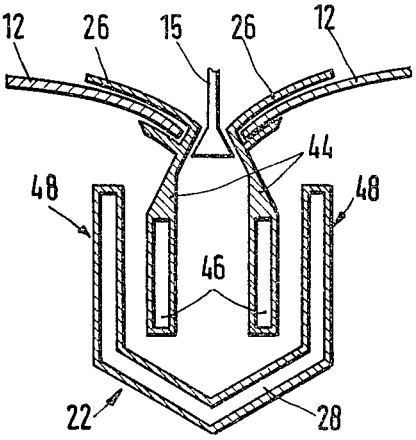
Fig. 4
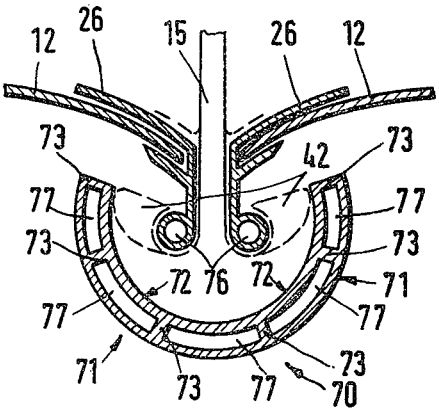
Fig. 5

CONDENSER CEILING FOR KITCHENS

BACKGROUND OF THE INVENTION

This invention relates to a protective subceiling for damp rooms, such as industrial canteens, slaughter houses, laundries and the like, against rising steam vapors and the precipitation of particles contained therein, above which there is arranged at least one exhaust port. The lateral edges of arched ceiling elements are lodged in collecting channels for the precipitation and are spaced from the walls of the collecting channels, and the collecting channels are connected with a condensate absorber.

Such subceilings are known from German Pat. Nos. 1,609,427 and 2,414,573, and prevent the precipitation of steam vapors and albuminous and fatty substances on the actual or support ceilings above. The subceiling has a surface promoting the formation of condensate, as well as collecting channels for the condensate and drain pipes to carry it off. In order to remove any fat that may have deposited outside of the collecting channels without involving intensive cleaning labor, according to the German specification No. 2,414,573 the subceiling is provided with a liquid film by means of spraying elements, by which the precipitated particles can be removed. Even though this method basically causes a cleaning of the subceiling surfaces, very often fatty and albuminous substances will deposit and accumulate in the space between the collecting channel and the adjacent lateral edges of the ceiling elements, and thus the draining of the condensate or escape of vapor is not guaranteed.

On the other hand, by wetting with a liquid a considerable additional portion of waste water is produced. Further, in order to thoroughly clean the subceilings the spraying water must be heated to different temperatures. Below 50° C. the albuminous substances are removed and above 50° C. the fatty ones are removed.

SUMMARY OF THE INVENTION

It is an object of the present invention to provide a subceiling of the above described kind enabling the removal of fatty and albuminous substances within the range of the collecting channels in an easy manner and without requiring any cleaning water, and to always provide a perfect eduction of air free from fatty and albuminous particles. The room under the ceiling is thus cleaned in a simple manner of aromatic substances, fatty particles, vapor, steam, and any other volatile substances influencing the room climate.

This problem is solved by the invention in that the collecting channels are configured as groovelike hollow profiles, to the interior spaces of which fluid can be supplied at adjustable temperatures.

By the configuration of the collecting channels according to the invention a fluid such as water or gases of different temperatures can be fed through the channels. In the area surrounding the collecting channels, i.e. the critical area for the precipitation of fatty and albuminous substances, temperatures can thus be generated permitting at first a removal of the albuminous substances and subsequently the discharge of the fatty substances. The former are carried off with the air at temperatures below approx. 50° C, the coagulating temperature for albumen, which air is then drawn off by ventilators arranged above the subceilings. If the temperature of the area is raised to approx. 70° to 80° C by the fluid, the deposited fat will melt and flow along the sloping collecting channels to reach a waste pipe connected with the channels.

The groovelike hollow profile can be of any configuration, but preferably is composed of two free flanges arranged at a distance parallel to each other, and a further flange of V-shape running straight or curved and connecting the two parallel flanges.

The temperature controlling fluid flows through chambers running parallel to the collecting channel, and the number of these chambers can either be even or odd. The chambers of the hollow profiles can be connected with each other so that the chambers of all collecting channels of an installed subceiling form a closed system that can be incorporated into an industrial or drinking water network.

By connection to such a network it will be obvious that as compared to the known subceilings, additional water consumption for the cleaning of the subceilings is eliminated and expensive energy consumption to temper the wasted water is prevented.

BRIEF DESCRIPTION OF THE DRAWING

In the drawings:

FIG. 2 is a sectional view of a collecting channel and fixture, and parts of ceiling elements engaged in the channel;

FIGS. 3A–3C are sectional views of different collecting channel embodiments;

FIG. 4 is a sectional view of a collecting channel and fixture connected therewith for ceiling elements, and FIG. 5 is a sectional view of another collecting channel and fixture embodiment.

DETAILED DESCRIPTION OF THE EMBODIMENTS

Figure 1:
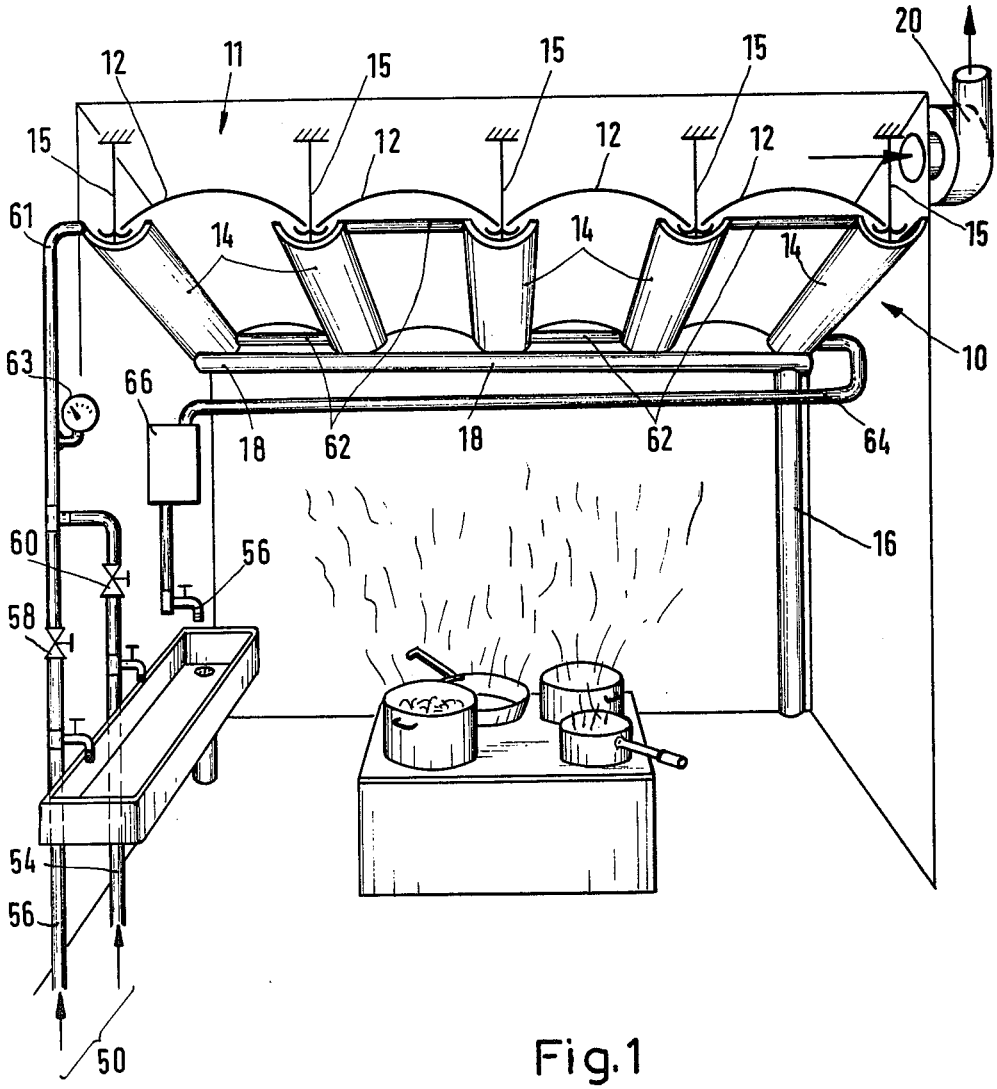
FIG. 1 is a perspective view of a room with a subceiling according to the invention, partially in sectional view.

In FIG. 1 a canteen is shown schematically. Underneath the main support ceiling 11 there is a subceiling 10 consisting of curved ceiling elements 12 with surfaces promoting the formation of condensate. With their lateral edges these element project into collecting channels 14 open toward the top, into which can flow the condensate precipitated on the ceiling elements 12. The collecting channels 14 are inclined in order to deliver the condensate to a waste pipe 16 via a cross drain 18 arranged at one end of the collecting channels. Between the lateral edges of the ceiling elements 12 and the inner walls of the collecting channels a distance is maintained by means of spacer elements for draining off the condensate and educting cleaned air or vapor. Ventilation is effected by an exhaust blower 20 connected with the room above the subceiling. These spacer elements will be described in more detail below. By means of a suspension or fixture 15 for the subceiling 10 they are connected with the support ceiling 11 or form a part thereof.

In order to precipitate or prevent any deposits 24 of fatty and albuminous substances (FIG. 2), especially in the area between the collecting channels 14, which in the example of FIG. 2 are of acute angled U-shape 22, and the adjacent edges of the ceiling elements 12 or, respectively, their fixture 26 of pocketlike design, this area can be adjusted to desired temperatures by supplying heat energy. At temperatures around 60° to 70° C, deposits 24 of precipitated fat will melt and flow off along the inner face of the collecting channel. The energy supply is effected by feeding fluid according to FIG. 1 through water of different temperatures to chambers 28 or hollow walls of collecting channels 14 or 22. The fluid supply can be effected continuously or preferably in timed intervals, depending on the kind of operation taking place in the damp working room that is covered by the ceiling. In a canteen it would be practical after a period during which a lot of fat was used and accordingly had been condensed on the ceiling, to feed warm water into the chambers 28 during a subsequent inactive time phase in order to remove the deposits 24. In addition, an improved result can be obtained by supplying cold water to the chamber 28 in order to carry off heat, which will promote condensation at the ceiling 10.

By heat-conducting connections between the collecting channels 14 or 22, or even only by convection, at least on the edges of the ceiling elements and in the area adjacent thereto, there similar temperatures will prevail similar temperatures as exist at the inner walls of the collecting channels.

The hollow chambers 28 of all elements of a ceiling 10 can be connected with each other as shown in FIG. 1 to a drinking water system 50, whereby the hollow profiles 14 will form a closed system.

Whenever heated or hot water is fed through the chambers 28 of the hollow-sectioned collecting channels 14 or 22, a "thawing off" of fatty deposits 24 will start at the edges of the ceiling elements and the areas adjacent thereto, as well as in the collecting channels. If cold water is admitted to the chambers 28, on the other hand, the formation of condensate is accelerated even on the curved ceiling elements and the parts supporting them.

Referring to the schematic view of FIG. 1, in the following there is described how water of desired temperature can be supplied to the groovelike hollow profiles. This example starts on the basic idea that in damp working rooms such as canteens, cold water can be taken directly from the water supply system, or warm water from a boiler or the like. The cold water as well as the warm one will preferably not be wasted but rather is reused after adding or carrying off some heat, whereby the slightly different heat content cannot be harmful but is even of advantage.

In order to accelerate the formation of condensate, cold water is admitted to the chambers of the collecting channels 14. In this case, the valve 58 is closed and the valve 60 is opened. By the complete or partial opening of the valves 58, 60, one can adjust the water flowing through the profiles 14 to any desired intermediate temperature, which, can be read on a thermometer 63.

The example described herewith is very simplified and schematized in order to clearly explain the basic idea. In practical operation, the supply and removal of warm and cold means to and from the chambers of the groovelike hollow profiles can be effected in any other manner. Instead of the means shown here, other sources can be used. The hand valves can be automatically adjustable valves, whereby sensors and/or other timing devices can effect the control of the valves. The supply line 61 does not have to be a single pipe, and the chambers, like the chamber 28 of the collecting channel according to FIG. 2, need not be connected in series as shown in FIG. 1 by the pipes 62 and 64. It is possible, for example to make a parallel arrangement with separate supply and drain lines for each individual collecting channel 14, area sections or groups of channels. In addition thereto, the chambers in the channels 14 can have separate cavities for the passage of cold and warm water and moreover can be of different shape. In order to explain these embodiments in more detail, in the following there are described some modifications by means of the other Figures.

The suspension arrangement 15 along each type of collecting channel 14 is arranged continuously or at distances. Each suspension 15 supports the curved ceiling elements 12 and each type of collecting channel 14 in such a manner that the ceiling elements 12 as well as the channels 14 can be removed separately of each other from the suspension 15. The connecting elements provided for this purpose, as 40 (FIG. 2), 42 (FIG. 5) are arranged in a longitudinal direction of the channels 14 at distances, which do not coincide with the drawing plane and therefore are entered in broken lines.

FIGS. 2 and 3*a* to 3*c* show essentially U-shaped channel profiles with acutely or roundly joined U-flanges. The channel profiles have one or several inner chambers. According to FIG. 2, the collecting channel 22 has a sole chamber 28 surrounded by the walls of the profile to accommodate a passing fluid. The chamber 28 as well as those described extends parallel to the longitudinal axis of the collecting channel. By the spacer element 40, the receiving device 26 is supported for engaging the edges of the ceiling elements 12. The spacer element 40 and the receiving device 26 are connected with the subceiling fixture 15.

According to FIG. 3, the U-shaped hollow profile 30 is generally composed of two free flanges 32 and 34 extending at a distance parallel to each other. In FIGS. 3*a* and 3*c*, both flanges 32 and 34 are joined by a V-shaped flange 31. According to FIG. 3*b*, this connection consists of a curved piece 33. The cavity of the profile 30 consists of chambers 35 and 37 separated from each other, of which the number can be even or odd. The partition 35 and 37 are separated by chamber walls 36.

The walls 36 are preferably heat-conducting in order to use less water to heat or cool the collecting channels. If, for example, as in FIGS. 3*a* and 3*b*, there are available three chambers 35 or 37 then alternately one chamber 35 can be filled with warm water and the other chamber 37 with cold water. If then, for example, the water circulation for warm water is open into the chambers 35 (the chambers 37 intended for cold water are not used in this case), then the latter are heated by the warm water passing through them. Thereby the water consumption can be reduced by setting the flowing water at a temperature ranging above the desired one. By an interchange of heat via the partition walls 36, the desired temperature will be obtained. The collecting channel 30 of FIG. 3*b* is basically constructed like that of FIG. 3*a*, however, in addition to the lower curved flange 33 it also presents chambers of oval section.

The outer shape of the profile 30 of FIG. 3*c* resembles approximately that of FIG. 3*a*, however it has two chambers 35*a* and 37*a* formed by partition walls 36*a* extending parallel to the flanges. This hollow profile arrangement makes it possible that the outer walls of the chamber 37*a* have a temperature preventing the formation of condensate and thus an undesired trickling down. The inner walls of the chamber 35*a*, however, are cooled in such a manner as to accelerate the formation of condensate. If, on the other hand, one wants to remove deposited fat, the inner chamber 35*a* can preferably be heated in order that a "thawing-off" can take place.

FIGS. 4 and 5 show arrangements of the subceiling 10 with respect to the collecting channel and fixtures for the ceiling elements 14, which will facilitate the removal of fat deposits and accelerate the formation of condensate. In these embodiments, chambers are provided not only in the channel 14 but also the receiving devices for the ceiling elements 12 have cavities through which water at different temperatures can be fed. These cavities can be connected with all or some part of the individual collecting channel chambers.

In FIG. 4 a collecting channel 22 with a chamber 28 is removably mounted not shown in a fixture 15. The ceiling elements 12 sit in pockets 26 provided with hollow longitudinal profiles 44 with chambers 46. The chambers 46 of rectangular section extend within the space between the free flanges 48 of the collecting channels 22, whereby the longer lateral surfaces are arranged parallel to the free flanges of the collecting channels.

FIG. 5 shows tubelike chambers 76 underneath the suspension 15. The hollow profile of the collecting channel 70 is composed of two concentric circular segments 71 and 72 joined by bridges 73, whereby the aperture exceeds 180°. Thereby it is guaranteed that the spacer elements 42 can support the collecting channel 70. In the present example, the spacer element 42 is configured as a catch lock to serve as a fixture for the collecting channel 70 in the form of an annular hollow profile with several chambers between the segments 71, 72 and the bridges 73.

By adjusting the temperatures of the water flowing through the cavities 46 or 76 or through the chambers 28 and 77, the removal of fatty deposits by liquefaction in the area between the fixtures and the inner walls of the collecting channels 22 or 70 is accomplished.

We claim:

1. In a subceiling for protecting damp rooms, such as industrial canteens, slaughter houses, laundries and the like, against rising steam vapors and the precipitation of particles contained therein, and including at least one overhead exhaust port, and a plurality of upwardly arched ceiling elements whose lateral edges are disposed approximate the openings of U-shaped collecting channels and spaced from the opposite walls of the collecting channels, the collecting channels being connected with a condensate absorber, the improvements characterized by: the collecting channels (14, 22, 30, 70) being configured as groovelike hollow profiles, and means for supplying fluid at desired temperatures into the interior cavities (28, 35, 37, 77) of the profiles.

2. A subceiling according to claim 1, wherein each collecting channel (14) is removably mounted and contains at least two chambers extending longitudinally therealong.

3. A subceiling according to claim 1, wherein each hollow profile (30) is subdivided in an outer and an inner chamber (37a, 35a) by a partition wall (36a) running parallel to its flanges (32, 34).

4. A subceiling according to claim 1, wherein the partition walls (36, 36a, 73) subdividing the groovelike hollow profiles (14, 22, 30, 70) into chambers (37, 73) are heat-conducting.

5. A subceiling according to claim 1, wherein the partition walls (36, 36a, 73) subdividing the groovelike hollow profiles (14, 22, 30, 70) into chambers (36, 73) are heat-insulating.

6. A subceiling according to claim 1, further comprising fixtures (15) for mounting the collecting channels (14, 22, 30, 70) and the arched ceiling elements (12) at a desired spacing, and cavities (46, 76) in the fixtures for carrying fluid at a desired temperature.

* * * * *